US012262799B2

(12) United States Patent
Xiao et al.

(10) Patent No.: US 12,262,799 B2
(45) Date of Patent: Apr. 1, 2025

(54) FIXING BELT ADJUSTING MECHANISM AND WEARABLE DEVICE

(71) Applicant: Luxshare Precision Industry Company Limited, Shenzhen (CN)

(72) Inventors: Haiou Xiao, Shenzhen (CN); Tingxin Xiao, Shenzhen (CN); Heng Zhang, Shenzhen (CN); Xiaolong Liu, Shenzhen (CN); Guanghong Yu, Shenzhen (CN)

(73) Assignee: Luxshare Precision Industry Company Limited, Shenzhen (CN)

( * ) Notice: Subject to any disclaimer, the term of this patent is extended or adjusted under 35 U.S.C. 154(b) by 0 days.

(21) Appl. No.: 18/195,117

(22) Filed: May 9, 2023

(65) Prior Publication Data

US 2023/0389663 A1 Dec. 7, 2023

(30) Foreign Application Priority Data

Jun. 1, 2022 (CN) ..... 202210617318.9

(51) Int. Cl.
*A42B 3/14* (2006.01)
*A44C 5/20* (2006.01)

(52) U.S. Cl.
CPC ..... *A44C 5/20* (2013.01)

(58) Field of Classification Search
CPC ..... A44B 11/006; A44B 11/008; A43C 11/16; A43C 11/20; A43C 11/22; Y10T 24/21; Y10T 24/2164; Y10T 24/2187
USPC ..... 2/417, 418, 424, 426
See application file for complete search history.

(56) References Cited

U.S. PATENT DOCUMENTS 430,962 A * 6/1890 Knisley ..... B60R 22/34 242/379
1,103,776 A * 7/1914 Jones ..... A44C 5/08 59/79.3
1,310,859 A * 7/1919 Eklund ..... A44C 5/08 224/179

(Continued)

FOREIGN PATENT DOCUMENTS

CN 111025637 A * 4/2020 ..... A42B 1/22
CN 111787825 A 10/2020

(Continued)

*Primary Examiner* — Jason W San
*Assistant Examiner* — Anna S Rashid
(74) *Attorney, Agent, or Firm* — Birch, Stewart, Kolasch & Birch, LLP

(57) ABSTRACT

A fixing belt adjusting mechanism and a wearable device are provided. The fixing belt adjusting mechanism includes a fixing base, a ratchet wheel, a driving member, a knob, a reset piece and a transmission wheel. The driving member may be rotated by the knob, so that a pawl drives the ratchet wheel to rotate in a first direction. Both ends of the reset piece are respectively connected with the fixing base and the ratchet wheel, so that the ratchet wheel may be driven to rotate and reset in a second direction. The transmission wheel coaxially and fixedly connected with the ratchet wheel may drive a first fixing belt and a second fixing belt to move towards or away from each other through rotation. Therefore, the fixing belt adjusting mechanism may achieve the effect of synchronously adjusting two fixing belts using a simple structure, which facilitates improving the user experience.

10 Claims, 15 Drawing Sheets

(56) References Cited

U.S. PATENT DOCUMENTS 1,817,475 A * 8/1931 Becker ..... A44C 5/22 63/3
1,831,666 A * 11/1931 Jacobia ..... A45F 5/004 242/385.4
2,205,741 A * 6/1940 Bowers ..... A42B 3/145 2/418
2,205,742 A * 6/1940 Bowers ..... A42B 3/145 2/418
2,248,338 A * 7/1941 Castleman ..... A45F 5/004 24/3.13
2,308,771 A * 1/1943 Mooney ..... A47K 5/05 242/379.2
2,511,234 A * 6/1950 Anderson ..... A42B 3/145 403/107
2,550,575 A * 4/1951 Malcom ..... A42B 3/145 24/19
2,695,740 A * 11/1954 Kolbe ..... A44C 5/0069 224/175
3,041,622 A * 7/1962 Gurtowski ..... A42B 3/145 2/8.1
3,090,046 A * 5/1963 Bowers, Sr. ..... A61F 9/06 24/274 WB
3,124,286 A * 3/1964 Dompier ..... A44B 15/00 224/220
3,214,809 A * 11/1965 Zahnor ..... A61F 9/06 2/418
3,325,824 A * 6/1967 Donegan ..... A61F 9/06 24/68 B
3,450,367 A * 6/1969 Edgell ..... G01B 3/1005 242/381.3
3,547,371 A * 12/1970 Gruseck ..... B65H 75/425 242/379.2
D225,039 S * 10/1972 Sauritis ..... D24/195
4,591,238 A * 5/1986 Kitaoka ..... A44C 25/00 40/364
5,351,906 A * 10/1994 Feathers ..... A62B 1/10 242/396.6
5,357,654 A * 10/1994 Hsing-Chi ..... A63B 33/002 2/418
5,490,805 A * 2/1996 Bredesen ..... B63B 32/73 242/379.2
5,950,245 A * 9/1999 Binduga ..... A42B 3/145 24/68 B
6,219,851 B1 * 4/2001 Fang ..... A42B 3/145 2/418
6,243,921 B1 * 6/2001 Chang ..... A61J 17/111 24/3.13
6,314,587 B1 * 11/2001 Fang ..... A42B 3/145 2/418
6,332,227 B1 * 12/2001 Fang ..... A42B 3/145 2/418
6,434,797 B1 * 8/2002 Sagman ..... A61J 17/00 242/381.3
6,708,376 B1 * 3/2004 Landry ..... A42B 3/145 2/418
6,711,788 B1 * 3/2004 Chen ..... A44B 11/008 2/322
7,000,262 B2 * 2/2006 Bielefeld ..... A42B 3/145 2/418
7,174,575 B1 * 2/2007 Scherer ..... A42B 3/145 2/418
7,228,651 B1 * 6/2007 Saari ..... A45F 5/004 24/3.12
7,384,013 B2 * 6/2008 Yen ..... B65H 75/4434 242/378
7,565,704 B2 * 7/2009 Wu ..... A42B 3/145 2/418
8,015,625 B2 * 9/2011 Grim ..... A42B 3/145 2/418
8,032,993 B2 * 10/2011 Musal ..... A42B 3/145 2/418
8,056,150 B2 * 11/2011 Stokes ..... A42B 3/145 2/418
8,156,574 B2 * 4/2012 Stokes ..... A42B 3/145 2/418
8,245,371 B2 * 8/2012 Chen ..... A43C 11/16 24/713.2
8,365,363 B2 * 2/2013 Chen ..... A44B 11/008 2/418
8,434,200 B2 * 5/2013 Chen ..... A42B 3/145 2/418
8,678,255 B2 * 3/2014 Zhang ..... B65H 75/4434 24/114.5
8,690,812 B2 * 4/2014 Moir ..... A61F 5/0123 602/26
9,161,588 B2 * 10/2015 Chen ..... A42B 3/324
9,357,811 B2 * 6/2016 Chiang ..... A42B 3/14
9,551,405 B1 * 1/2017 Chen ..... A41D 13/0556
9,572,392 B2 * 2/2017 Klotz ..... A42B 1/22
9,706,814 B2 * 7/2017 Converse ..... A61F 5/0123
10,558,052 B2 * 2/2020 Chang ..... A43C 11/165
10,561,208 B2 * 2/2020 Cui ..... A44C 5/2071
10,634,923 B2 * 4/2020 Wang ..... G02B 27/0176
10,915,141 B2 * 2/2021 Yan ..... G02B 27/0176
11,096,439 B2 * 8/2021 King ..... A42B 3/145
11,116,667 B1 * 9/2021 McKenna ..... A63B 33/004
11,185,120 B2 * 11/2021 Manni ..... A42B 1/22
11,419,391 B2 * 8/2022 Dong ..... F16H 19/04
11,786,017 B2 * 10/2023 Granito ..... A44C 5/246 63/3.2
11,953,079 B2 * 4/2024 Chen ..... F16H 19/04
2005/0011981 A1 * 1/2005 Baumgarten ..... B65H 75/48 242/379
2006/0032027 A1 * 2/2006 Shiue ..... A44B 11/065 24/191
2008/0035778 A1 * 2/2008 Belden ..... B65H 75/446 242/375
2008/0109947 A1 * 5/2008 Dubois ..... A42B 3/145 2/414
2008/0295229 A1 * 12/2008 Fang ..... A42B 3/145 2/418
2009/0184189 A1 * 7/2009 Soderberg ..... A43C 11/16 242/395
2010/0095438 A1 * 4/2010 Moelker ..... A42B 3/145 2/418
2011/0088148 A1 * 4/2011 Chen ..... A42B 3/145 2/418
2011/0191946 A1 * 8/2011 Fang ..... A42B 3/145 2/418
2012/0001008 A1 * 1/2012 Huang ..... B65H 75/48 242/375
2013/0219668 A1 * 8/2013 Bredesen ..... A01K 87/007 24/3.13
2015/0014463 A1 1/2015 Converse et al.
2015/0107006 A1 4/2015 Chen
2015/0144728 A1 * 5/2015 Chen ..... B65H 75/48 242/375
2015/0313319 A1 * 11/2015 Ha ..... A43C 11/165 24/712
2016/0015136 A1 * 1/2016 Yue ..... A44C 5/2052 63/1.11
2019/0150569 A1 * 5/2019 Chen ..... A43C 11/00
2021/0289889 A1 * 9/2021 Chen ..... B65H 75/48
2022/0142304 A1 * 5/2022 Chen ..... A43C 11/008
2023/0056011 A1 * 2/2023 Chen ..... A43C 11/165
2024/0122302 A1 * 4/2024 Chen ..... A43C 11/165

FOREIGN PATENT DOCUMENTS

CN 112586843 A * 4/2021 ..... A44C 5/0069
CN 215599513 U * 1/2022
CN 215601058 U * 1/2022
CN 114158830 A * 3/2022
CN 216165677 U * 4/2022
CN 216597177 U * 5/2022
JP 2003052426 A * 2/2003 ..... A44C 5/22

(56) References Cited

FOREIGN PATENT DOCUMENTS

| | | | | | |
|---|---|---|---|---|---|
| JP | 2013118891 | A | * | 6/2013 | |
| JP | 2014204833 | A | * | 10/2014 | ..... A44C 15/005 |

* cited by examiner

FIXING BELT ADJUSTING MECHANISM AND WEARABLE DEVICE

CLAIM OF PRIORITY AND CROSS-REFERENCE TO RELATED APPLICATION(S)

This application claims the benefit of Chinese Patent Application No. 202210617318.9, filed on Jun. 1, 2022, which is incorporated herein by reference in its entirety.

BACKGROUND OF THE INVENTION

1. Field of the Invention

The present disclosure relates to the technical field of wearability, and in particular to a fixing belt adjusting mechanism and a wearable device.

2. Description of the Related Art

At present, when the tightness of some electronic wearable products on the market is adjusted, a situation where one end is loose and the other end is tight generally happens, which leads to a problem of unstable wearing. With the increase of use time, the electronic product is easy to loose and fall off, which affects the user experience.

BRIEF DESCRIPTION OF THE INVENTION

In view of this, the present disclosure aims to provide a fixing belt adjusting mechanism and a wearable device. A ratchet wheel and a driving member are arranged, and a knob and a reset piece are matched with a transmission wheel to achieve the effect of synchronously adjusting two fixing belts.

According to a first aspect, the embodiments of the present disclosure provide a fixing belt adjusting mechanism. The fixing belt adjusting mechanism includes: a fixing base, a ratchet wheel, a driving member, a knob, a reset piece and a transmission wheel; the ratchet wheel is arranged on the fixing base in a rotatable manner; a pawl matched with the ratchet wheel is arranged on the driving member, and the driving member is arranged on the fixing base in a rotatable manner; the knob is arranged on the fixing base in a rotatable manner and configured to drive the driving member to rotate, so that the pawl drives the ratchet wheel to rotate in a first direction; both ends of the reset piece are respectively connected with the fixing base and the ratchet wheel, and the reset piece is configured to drive the ratchet wheel to rotate and reset in a second direction; and the transmission wheel is coaxially and fixedly connected with the ratchet wheel and configured to drive a first fixing belt and a second fixing belt to move towards or away from each other through rotation.

Further, the fixing belt adjusting mechanism further includes: a fastening component. The fastening component is arranged on the fixing base and connected with the knob for fastening the knob.

Further, the fastening component includes: a fixing bolt and a fastening spring. The fixing bolt is fixedly arranged on the fixing base, a top end of the fixing bolt is connected to the knob in a rotatable manner, and a bottom end of the fixing bolt is provided with a flange; and the fastening spring is arranged on the fixing bolt in a sleeving manner, and both ends of the fastening spring respectively abut against the fixing base and the flange.

Further, the fixing bolt includes a main body part and a connecting part extending from the top end of the main body part towards the knob; the fastening spring is arranged on the main body part in a sleeving manner; the flange is located at the bottom end of the main body part; and the fixing bolt is connected with the knob in a rotatable manner through the connecting part.

Further, the driving member is provided with a stressed part; and the knob is provided with a pushing part, and the knob is configured to push the stressed part to rotate in the first direction through the pushing part.

Further, the knob is provided with a lifting part, and the knob is configured to lift the pawl away from the ratchet wheel through the lifting part.

Further, the reset piece is a coil spring, and both ends of the coil spring are respectively connected with the fixing base and the ratchet wheel.

Further, the ratchet wheel is provided with a groove, and a first protrusion is formed at the bottom of the groove; and the coil spring is arranged in the groove, and a first end of the coil spring is connected with the first protrusion.

Further, the fixing base is provided with a second protrusion; the ratchet wheel is arranged on the second protrusion in a sleeving manner, so that the second protrusion is located in the groove; and a second end of the coil spring is connected with the second protrusion.

According to a second aspect, the embodiments of the present disclosure further provide a wearable device. The wearable device includes: the fixing belt adjusting mechanism as described in the first aspect, a first fixing belt and a second fixing belt, where the first fixing belt and the second fixing belt are configured to be in driving connection with the transmission wheel in opposite directions.

Embodiments of the present disclosure provide a fixing belt adjusting mechanism and a wearable device. The fixing belt adjusting mechanism includes a fixing base, a ratchet wheel, a driving member, a knob, a reset piece and a transmission wheel. The ratchet wheel, the driving member and the knob are arranged on the fixing base in a rotatable manner, and the driving member may be rotated by the knob, so that a pawl drives the ratchet wheel to rotate in a first direction. Meanwhile, both ends of the reset piece are respectively connected with the fixing base and the ratchet wheel, so that the ratchet wheel may be driven to rotate and reset in a second direction. In addition, the transmission wheel coaxially and fixedly connected with the ratchet wheel may drive a first fixing belt and a second fixing belt to move towards or away from each other through rotation. Therefore, the fixing belt adjusting mechanism may achieve the effect of synchronously adjusting two fixing belts using a simple structure, which facilitates improving the user experience.

BRIEF DESCRIPTION OF THE DRAWINGS

The foregoing and other objectives, features and advantages of the present disclosure will become more apparent from the following description of embodiments of the present disclosure with reference to the accompanying drawings, in which.

DETAILED DESCRIPTION OF EMBODIMENTS OF THE INVENTION

The present disclosure is described below based on the embodiments, but the present disclosure is not limited thereto. In the following detailed description of the present disclosure, certain specific details are described in detail. The present disclosure may be fully understood by those skilled in the art without the description of these detailed parts. In order to avoid confusing the substance of the present disclosure, well-known methods, processes, flows, elements and circuits have not been described in detail.

In addition, it should be understood by those of ordinary skill in the art that the drawings provided herein are for illustrative purposes, and the drawings are not necessarily drawn to scale.

Unless expressly required in the context, the terms "include", "comprise", and other similar words should be construed as inclusive rather than exclusive or exhaustive, that is, the meaning of "including, but not limited to".

In the description of the present disclosure, it should be understood that the terms "first", "second", etc. are merely used for descriptive purposes, but cannot be understand as indicating or implying relative importance. In addition, in the description of the present disclosure, unless otherwise stated, "a plurality of" means two or more.

Figure 1:
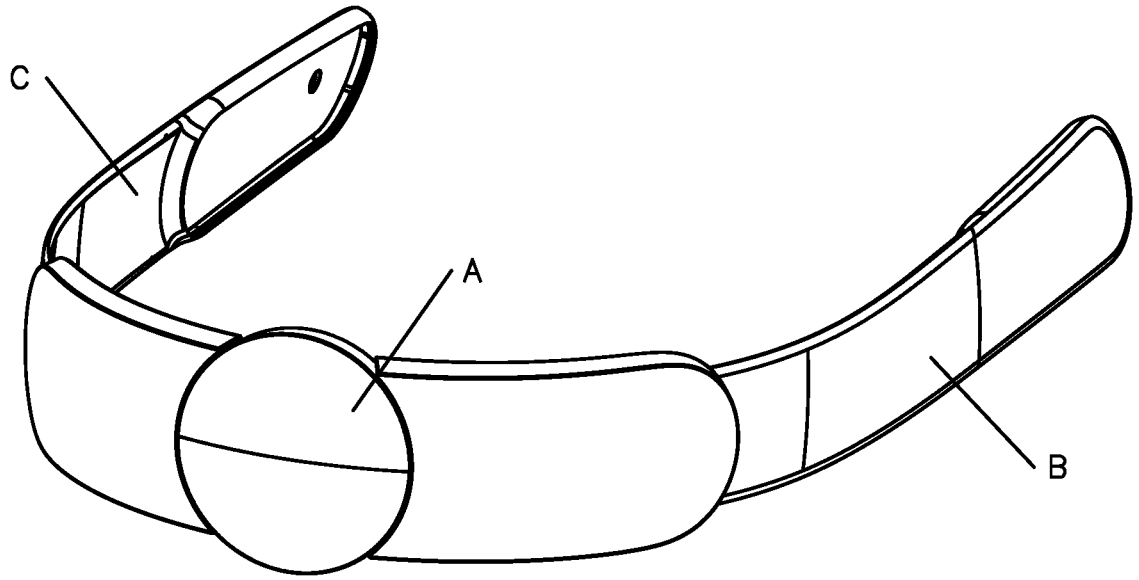
FIG. 1 is a schematic structure diagram of a wearable device provided by an embodiment of the present disclosure.
Figure 2:
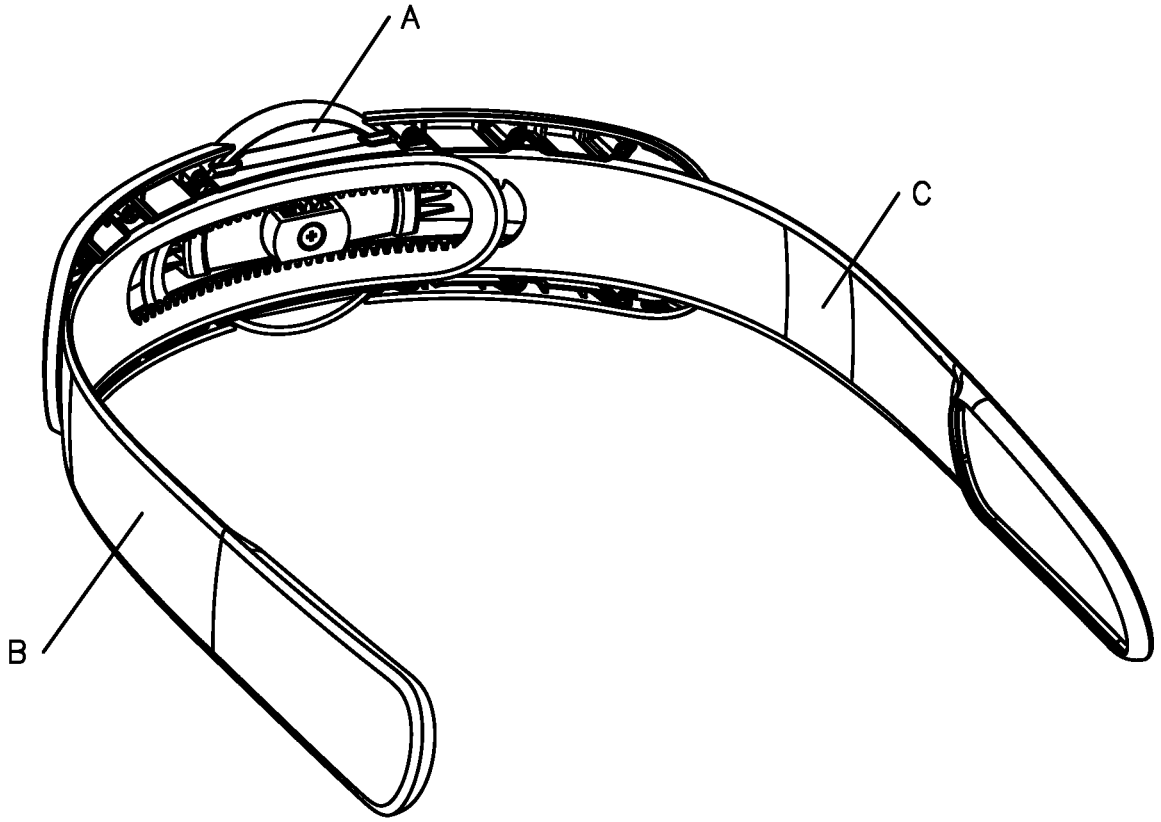
FIG. 2 is a schematic structure diagram of another view of a wearable device provided by an embodiment of the present disclosure.
Figure 3:
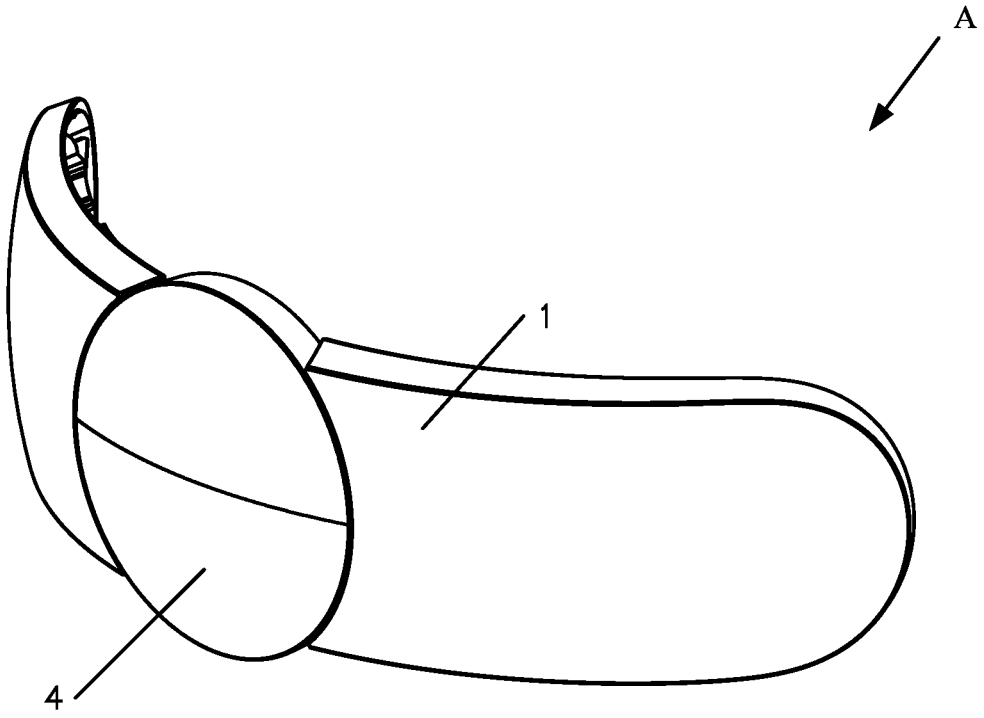
FIG. 3 is a schematic structure diagram of a fixing belt adjusting mechanism provided by an embodiment of the present disclosure.
Figure 4:
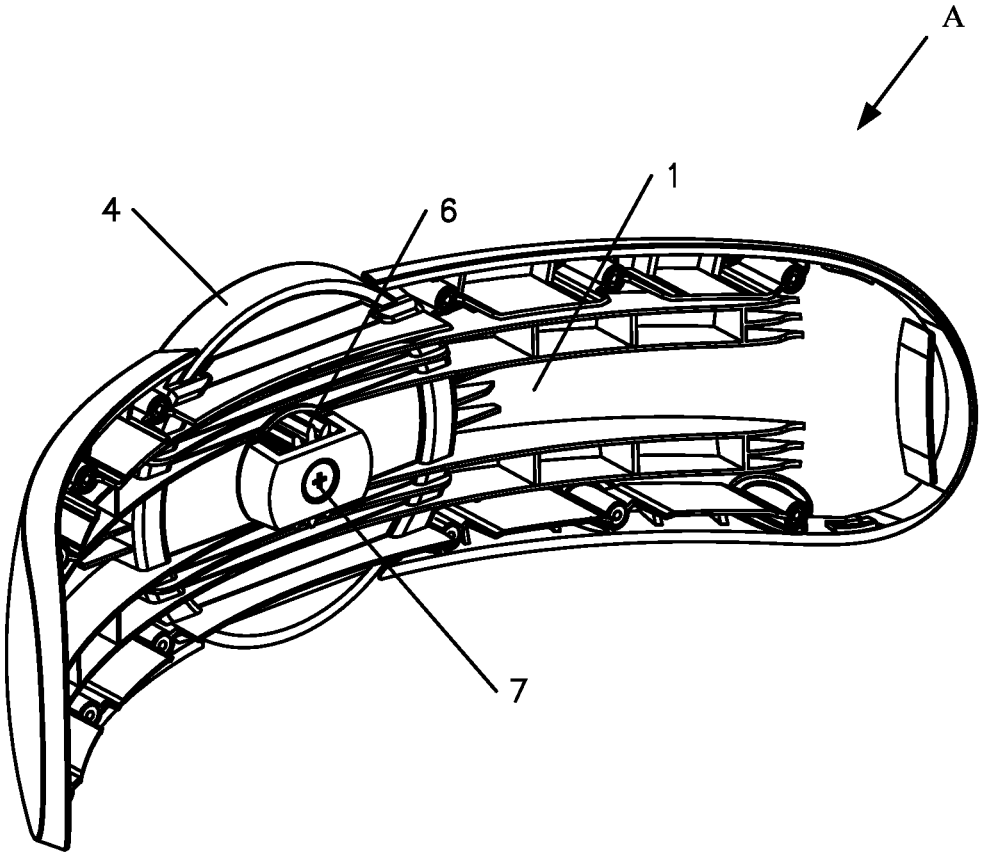
FIG. 4 is a schematic structure diagram of another view of a fixing belt adjusting mechanism provided by an embodiment of the present disclosure.
Figure 5:
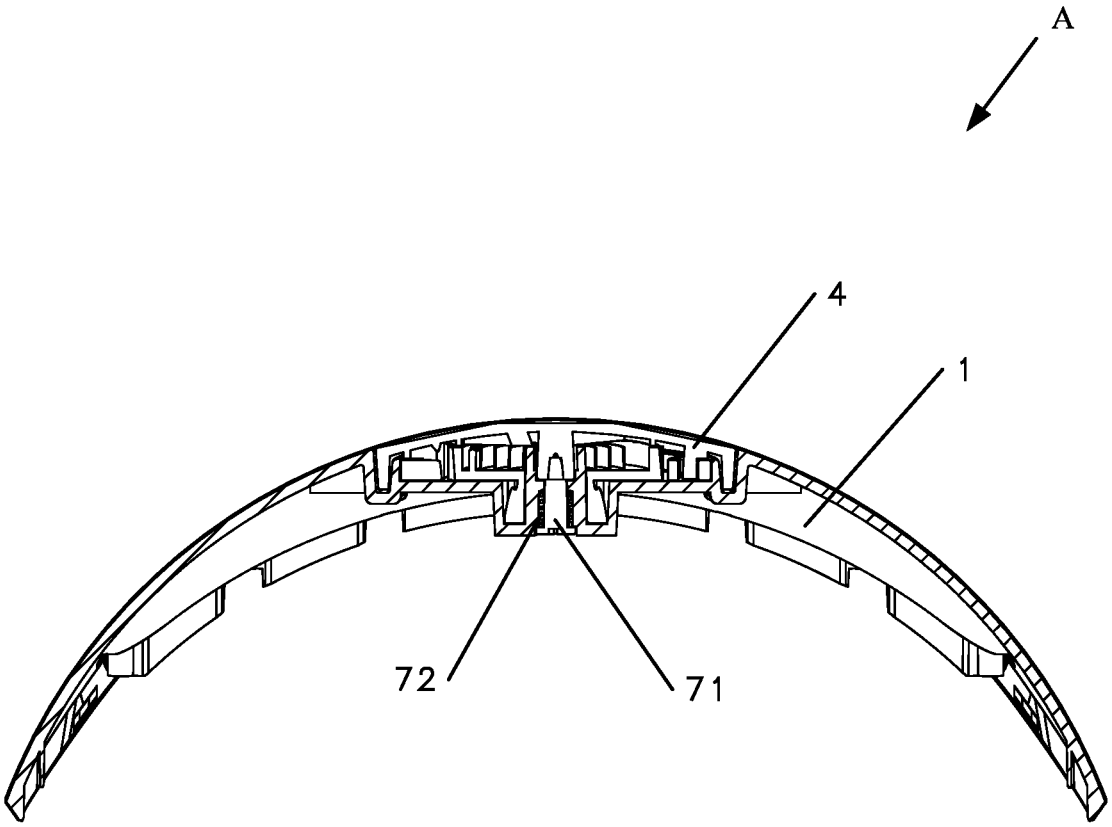
FIG. 5 is a schematic sectional diagram of a fixing belt adjusting mechanism provided by an embodiment of the present disclosure.
Figure 6:
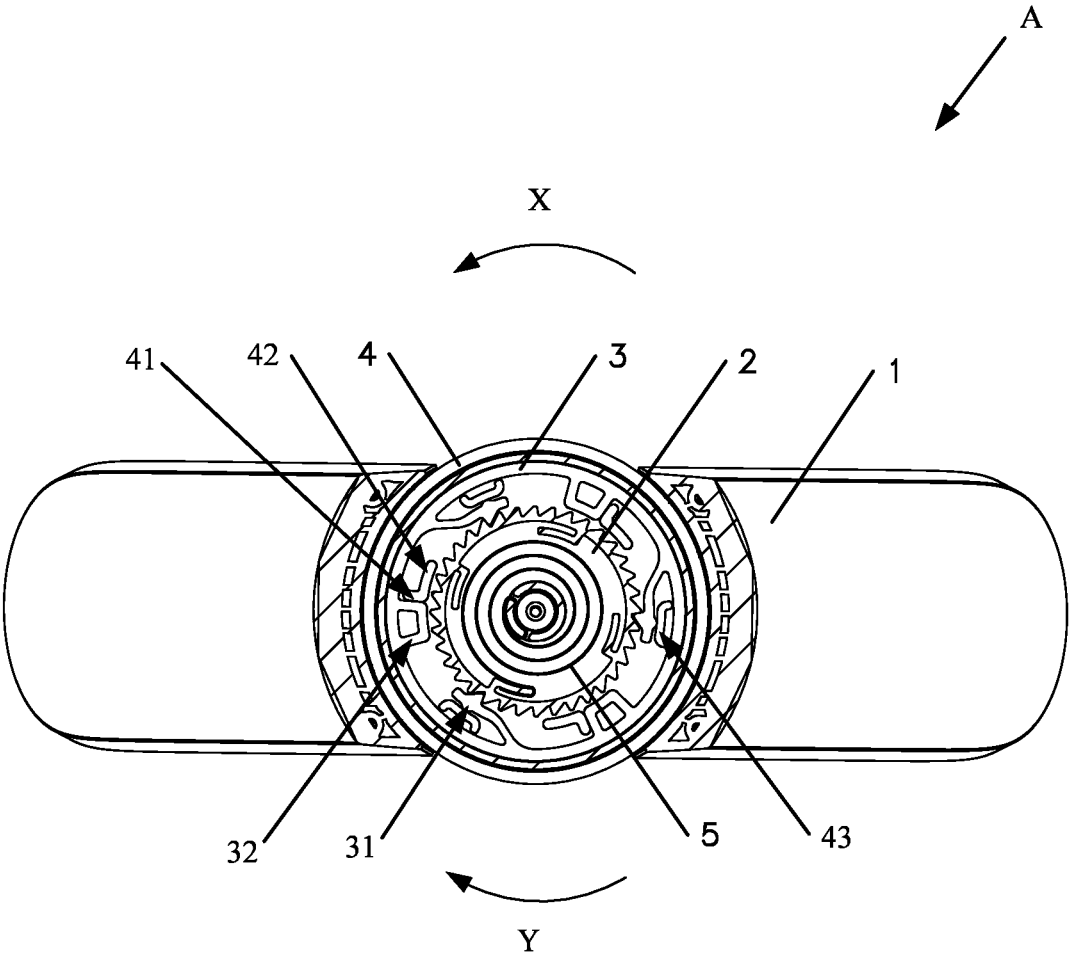
FIG. 6 is a schematic sectional diagram of another view of a fixing belt adjusting mechanism provided by an embodiment of the present disclosure.
Figure 7:
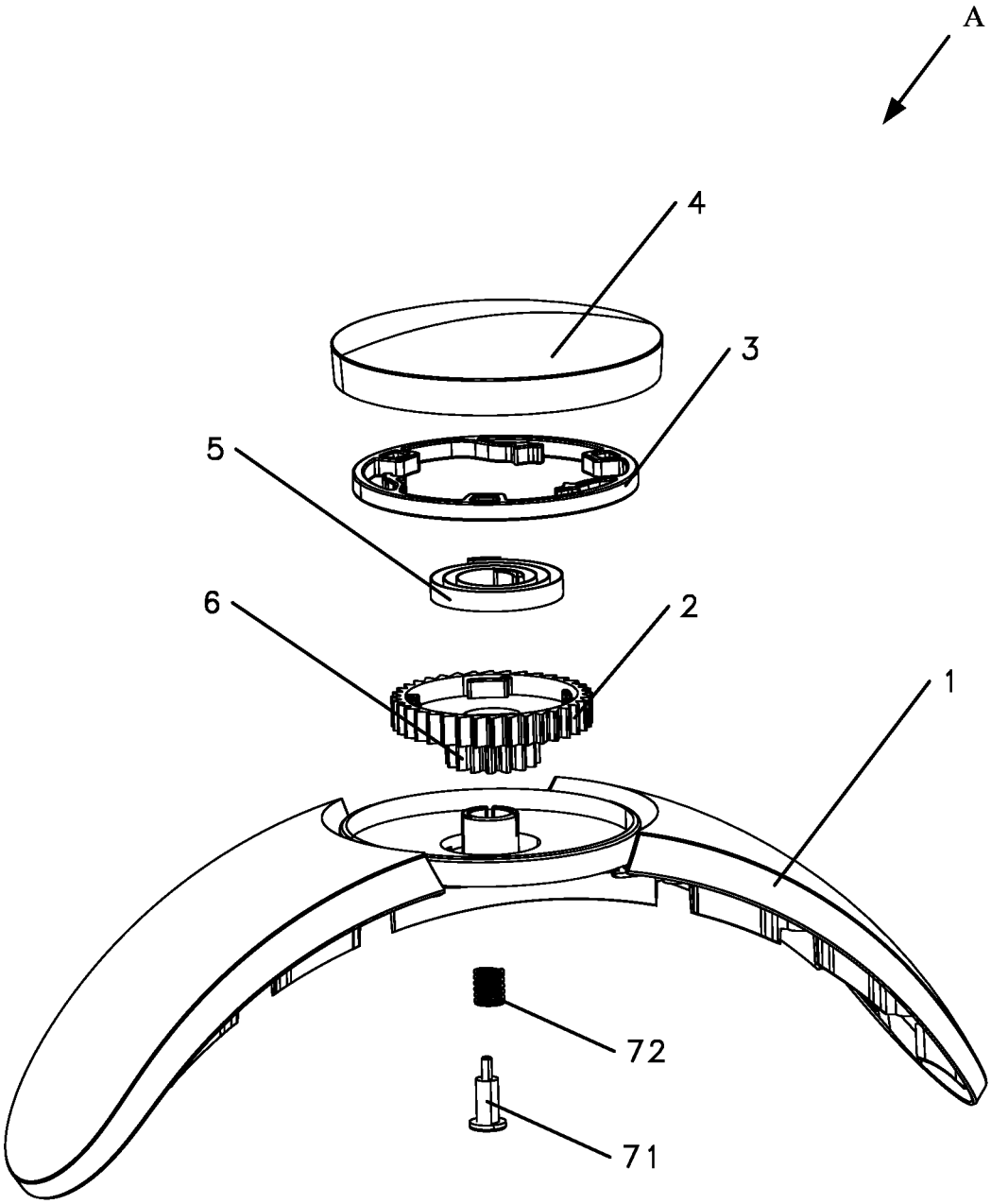
FIG. 7 is a schematic explosive structure diagram of a fixing belt adjusting mechanism provided by an embodiment of the present disclosure.

FIGS. 1 and 2 are schematic diagrams of a wearable device provided by the embodiments of the present disclosure. The wearable device includes various wearable devices such as a smart watch, smart glasses and a smart bracelet. As shown in FIGS. 1 and 2, the wearable device includes a first fixing belt B and a second fixing belt C, and a user can fixedly wear the wearable device on a corresponding part of the body through the first fixing belt B and the second fixing belt C. Due to different body structures of different users, it is necessary to adjust the positions of the first fixing belt B and the second fixing belt C, that is, to adjust the tightness of the fixing belt for the users to wear. Further, the wearable device further includes a fixing belt adjusting mechanism A configured to adjust the positions of the first fixing belt B and the second fixing belt C, that is, to adjust the tightness of the fixing belt. The fixing belt adjusting mechanism A provided by the embodiments of the present disclosure may achieve the effect of synchronously adjusting two fixing belts using a simple structure, which facilitates improving the user experience.

FIGS. 3 to 7 are schematic diagrams of the fixing belt adjusting mechanism A provided by the embodiments of the present disclosure. As shown in FIGS. 3 to 7, the fixing belt adjusting mechanism A includes a fixing base 1, a ratchet wheel 2, a driving member 3, a knob 4, a reset piece 5 and a transmission wheel 6. Herein, the ratchet wheel 2, the driving member 3 and the knob 4 are arranged on the fixing base 1 in a rotatable manner. Further, the driving member 3 is provided with a pawl 31 matched with the ratchet wheel 2. When the user rotates the knob 4 in a first direction X, the driving member 3 may rotate in the first direction X, so that the ratchet wheel 2 may be driven to rotate in the first direction X through the pawl 31. Meanwhile, both ends of the reset piece 5 are respectively connected with the fixing base 1 and the ratchet wheel 2. Furthermore, the transmission wheel 6 and the ratchet wheel 2 are coaxially and fixedly connected.

When the ratchet wheel 2 rotates in the first direction X and drives the transmission wheel 6 to rotate in the first direction X, thus driving the first fixing belt B and the second fixing belt C to move away from each other synchronously, the two fixing belts are in a loose state, and the reset piece 5 is deformed. When the user rotates the knob 4 in the second direction Y to remove external force, the reset piece 5 is restored to the original state and enables the ratchet wheel 2 to rotate and reset in the second direction Y, thereby driving the transmission wheel 6 to rotate in the second direction Y, and further driving the first fixing belt B and the second fixing belt C to move synchronously towards each other, so that the two fixing belts are in a tightened state. Therefore, the user may perform wearing using one knob 4 to synchronously adjust the two fixing belts, which is easy to wear, so that the user experience is improved.

In one implementation, the first direction X is counterclockwise and the second direction Y is clockwise. As an optional implementation, the first direction X is clockwise and the second direction Y is counterclockwise. It is easy to understand that in order to enable the first fixing belt B and the second fixing belt C to move towards or away from each other synchronously, the first fixing belt B and the second fixing belt C need to be in driving connection with the transmission wheel 6 in opposite directions.

Figure 8:
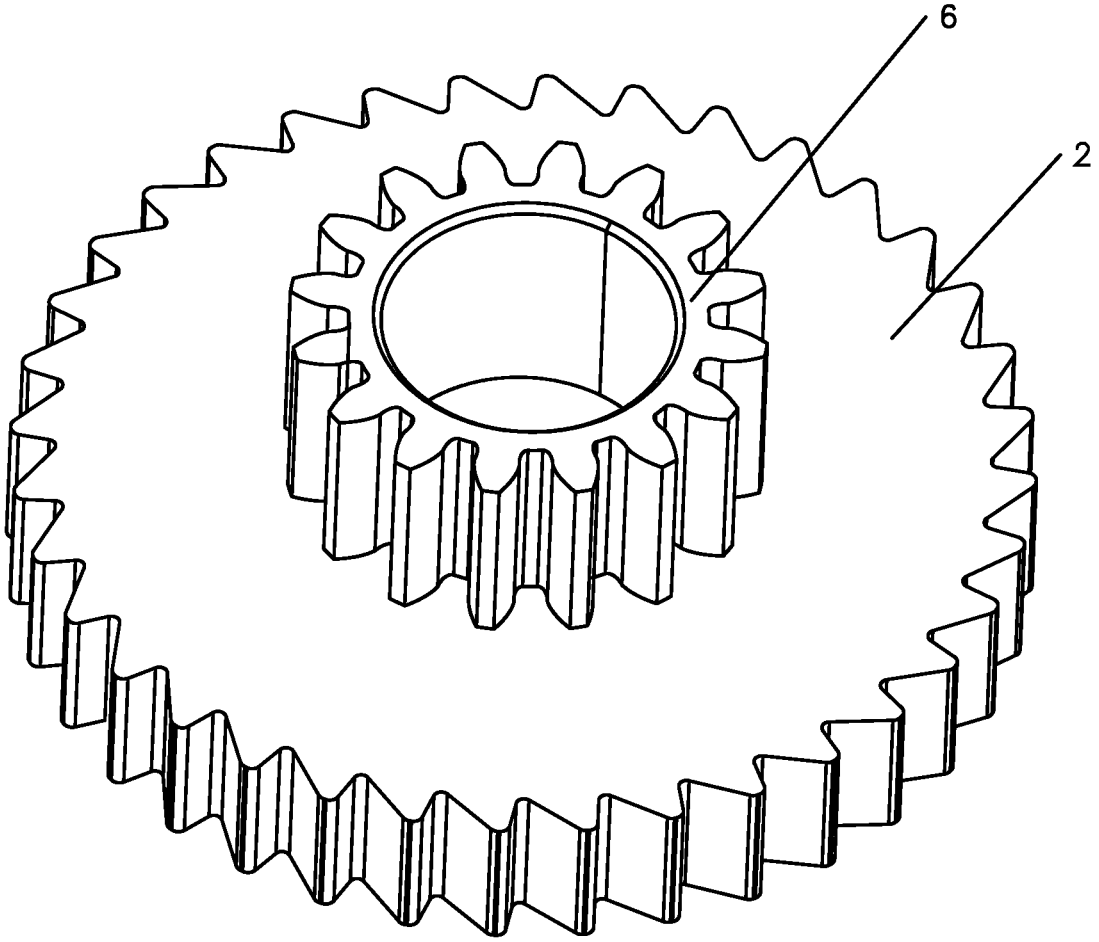
FIG. 8 is a schematic structure diagram of a ratchet wheel and a transmission wheel provided by an embodiment of the present disclosure.

FIG. 8 is a schematic structure diagram of the ratchet wheel 2 and the transmission wheel 6 provided by the embodiment of the present disclosure. As shown in FIG. 8, in one implementation, the transmission wheel 6 and the ratchet wheel 2 are integrally formed, which are simple in structure and convenient to install, and may ensure the reliability of motion transmission. As an optional implementation, the transmission wheel 6 may be coaxially connected with the ratchet wheel 2 through a connecting rod or another structure.

In one implementation, the fixing belt adjusting mechanism A further includes a fastening component 7. Specifically, the fastening component 7 is arranged on the fixing base 1 and connected with the knob 4. When the user rotates the knob 4 in the first direction X and releases the knob 4, the fastening component 7 may fasten the knob 4. That is, the fastening component 7 may keep the ratchet wheel 2 and the transmission wheel 6 stationary after rotating in the first direction X, thus keeping the fixing belt in a loose state, which brings convenience for the user to wear. It is easy to understand that fastening force generated by the fastening component 7 is greater than elastic force generated by the deformation of the reset piece 5, so that the ratchet wheel 2 and the transmission wheel 6 may be prevented from rotating in the second direction Y immediately after the external force is removed by the user, thereby avoiding the fixing belt from being tightened to affect the wearing experience of the user.

Figure 9:
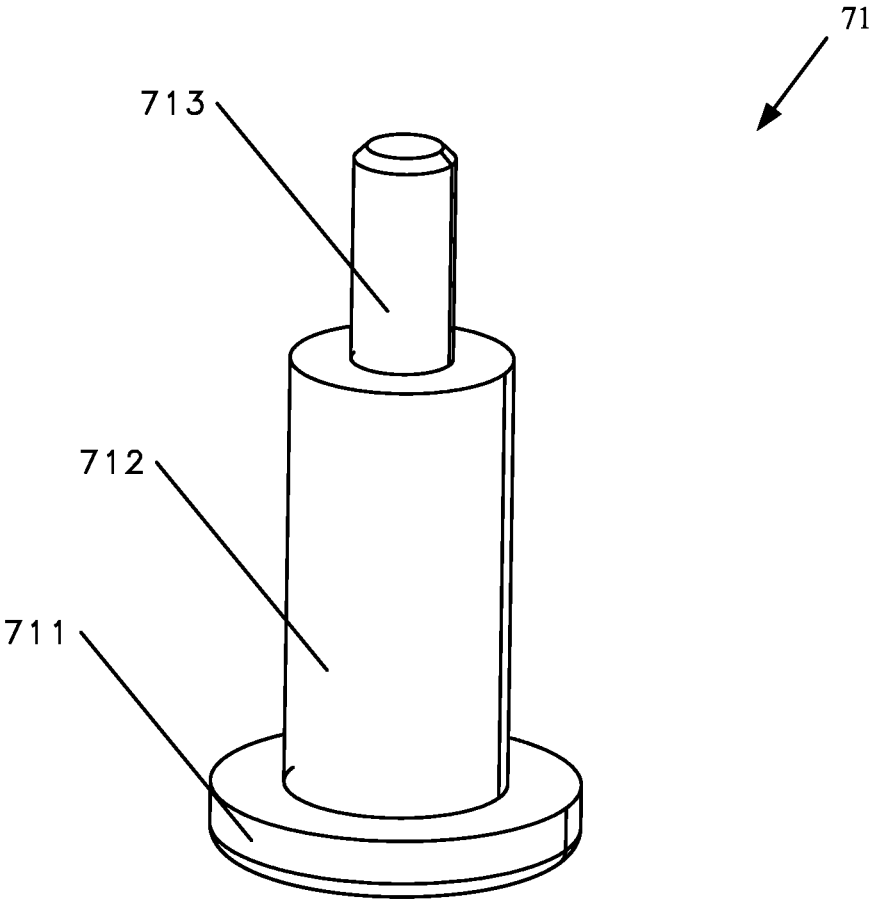
FIG. 9 is a schematic structure diagram of a fixing bolt provided by an embodiment of the present disclosure.

In one implementation, the fastening component 7 includes a fixing bolt 71 and a fastening spring 72. Specifically, the fixing bolt 71 is fixedly arranged on the fixing base 1, and a top end of the fixing bolt 71 is connected with the knob 4 in a rotatable manner. Therefore, friction between the fixing bolt 71 and the knob 4 may tighten the knob 4. Further, FIG. 9 is a schematic structure diagram of the fixing bolt 71 provided by the embodiment of the present disclosure. As shown in FIG. 9, a bottom end of the fixing bolt 71 is provided with a flange 711. The fastening spring 72 is arranged on the fixing bolt 71 in a sleeving manner, and both ends of the fastening spring 72 respectively abut against the fixing base 1 and the flange 711. It should be noted that the fastening spring 72 is in a deformed state, and is configured to enhance the friction between the fixing bolt 71 and the knob 4 through the elastic force generated by deformation, so that the knob 4 may be kept stationary after rotating in the first direction X to bring convenience for the user to wear.

Specifically, the fixing bolt 71 includes a main body part 712 and a connecting part 713 extending from the top end of the main body part 712 towards the knob 4. Further, the fastening spring 72 is arranged on the main body part 712 in a sleeving manner, and the flange 711 is located at the bottom end of the main body part 712. Furthermore, the fixing bolt 71 is connected with the knob 4 in a rotatable manner through the connecting part 713.

Figure 10:
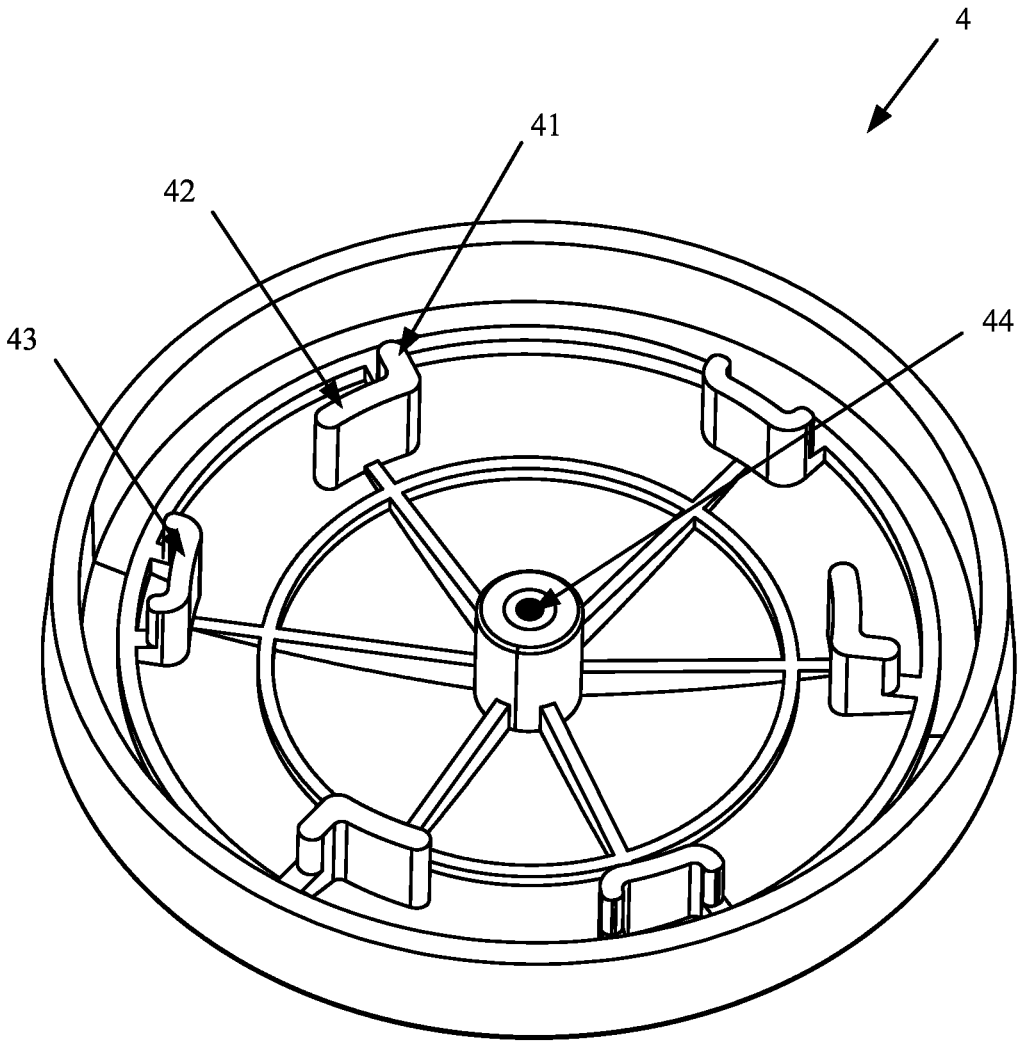
FIG. 10 is a schematic structure diagram of a knob provided by an embodiment of the present disclosure.

It should be noted that as an optional implementation, the fixing bolt 71 is connected with the knob 4 in a threaded manner through the connecting part 713. As shown in FIG. 10, the connecting part 713 is provided with an external thread, and the knob 4 is provided with a matching threaded hole 44. When the connecting part 713 is screwed into the threaded hole 44 in the knob 4, the elastic force generated by the deformation of the fastening spring 72 may increase the pressure of the threaded connecting part, so that the fastening effect of the fastening component 7 may be realized by increasing the friction. It is easy to understand that by selecting springs with different specifications or screwing the fixing bolt 71 into different depths, it is possible to adjust the rotation tightness of the knob 4 according to actual needs. It should be further noted that the threaded hole 44 is located at a rotation center of the knob 4. Optionally, the connecting part 713 is provided with a threaded hole, and the knob 4 is correspondingly provided with a matching screw.

Figure 11:
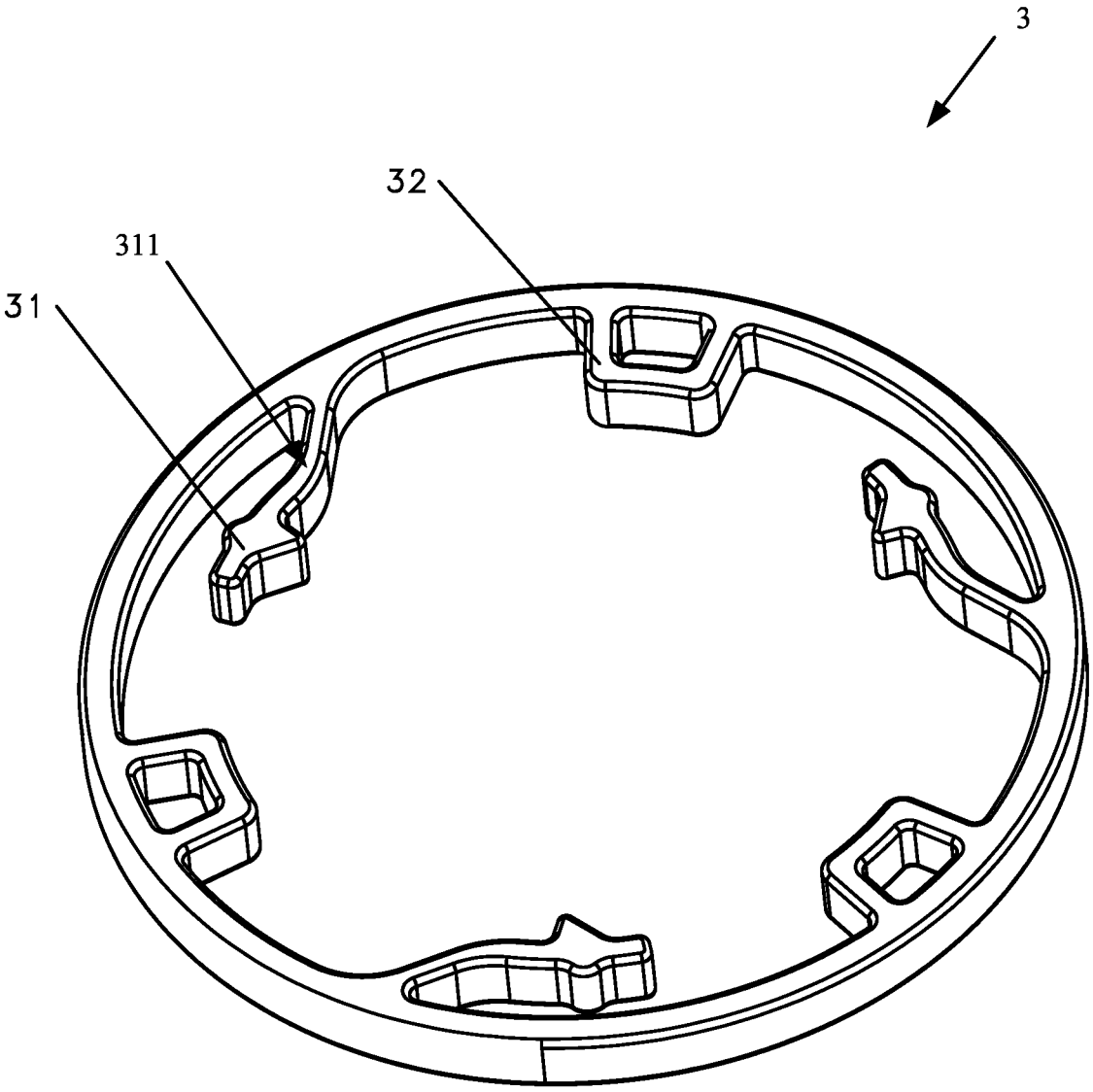
FIG. 11 is a schematic structure diagram of a driving member provided by an embodiment of the present disclosure.

FIG. 11 is a schematic structure diagram of the driving member 3 provided by the embodiment of the present disclosure. As shown in FIG. 11, in one implementation, the driving member 3 is provided with a stressed part 32. Correspondingly, the knob 4 is provided with a pushing part 41. When the user rotates the knob 4 in the first direction X, the knob 4 may push the stressed part 32 in the first direction X through the pushing part 41, so that the driving member 3 may rotate in the first direction X, and then the pawl 31 on the driving member 3 may drive the ratchet wheel 2 to rotate. It should be noted that in the present implementation, three stressed parts 32 and three pushing parts 41 are provided and are arranged at intervals. Therefore, the knob 4 and the driving member 3 may be ensured to be uniformly stressed, which facilitates improving the stability of the mechanism. Optionally, one, two or more stressed parts 32 and pushing parts 41 may also be arranged.

In one implementation, the pawl 31 is arranged on the driving member 3 through an extension part 311. Herein, the extension part 311 is made of an elastic material. Further, the knob 4 is provided with a lifting part 42. When the user rotates the knob 4 in the second direction Y, the lifting part 42 is rotated to the pawl 31, so that the extension part 311 may be deformed by further rotation, and the pawl 31 may be lifted away from the ratchet wheel 2. Therefore, the reset piece 5 may be restored to the original state in the absence of the external force, so that the ratchet wheel 2 rotates in the second direction Y, and the first fixing belt B and the second fixing belt C are driven by the transmission wheel 6 to move synchronously towards each other, so that the fixing belt enters the tightened state, thus bringing convenience for the user to wear. In the present implementation, the lifting part 42 and the pushing part 41 are integrally formed into an L-shaped structure, so as to simplify the structure of the knob 4.

In one implementation, a rigid toothed surface is formed on the outer edge of the ratchet wheel 2, and the pawl 31 is correspondingly formed into a toothed hook structure, so that the ratchet wheel 2 may be hooked and driven to rotate. Further, the knob 4 is provided with a supporting part 43, and the supporting part 43 keeps a certain distance from the lifting part 42. When the user rotates the knob 4 in the first direction X, the lifting part 42 is separated from the extension part 311. When the pushing part 41 rotates to contact the stressed part 32, the supporting part 43 pushes the pawl 31 into a toothed groove of the ratchet wheel 2, and the supporting part 43 continuously supports the pawl 31 during the rotation of the knob 4, so as to prevent the pawl 31 from falling off to disable the mechanism. It should be noted that the number of the supporting parts 43 is equal to the number of the pawls 31. It should be further noted that the ratchet wheel 2 in the present implementation is a toothed ratchet wheel, which may ensure the reliability of transmission. As an optional implementation, the ratchet wheel 2 may be a friction ratchet wheel, and the motion is transmitted by the friction between the ratchet wheel 2 and the pawl 31.

Figure 12:
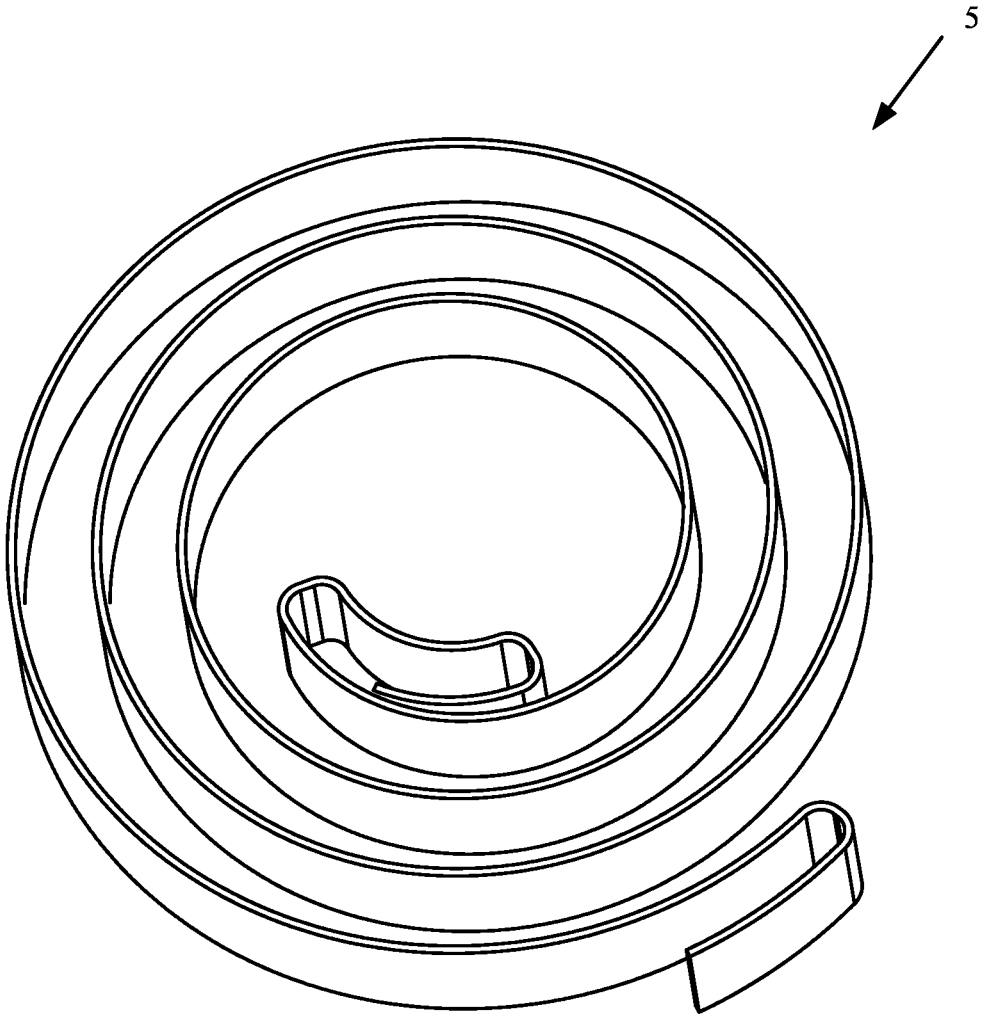
FIG. 12 is a schematic structure diagram of a reset piece provided by an embodiment of the present disclosure.

FIG. 12 is a schematic structure diagram of the reset piece 5 provided by the embodiment of the present disclosure. As shown in FIG. 12, in one implementation, the reset piece 5 is a coil spring (or called clockwork spring), and both ends of the coil spring are respectively connected with the fixing base 1 and the ratchet wheel 2. Specifically, one end of the coil spring is fixedly arranged on the fixing base 1. When the user rotates the knob 4 in the first direction X and drives the ratchet wheel 2 to rotate, the other end of the coil spring rotates with the ratchet wheel 2, so that the coil spring generates bending elastic deformation. When the user rotates the knob 4 in the second direction Y, the coil spring recovers and drives the ratchet wheel 2 to rotate in the second direction Y since the pawl 31 is lifted away from the ratchet wheel 2. It should be noted that the coil spring in the present implementation has the advantages of more energy storage, less fatigue and the like. As an optional implementation, other springs such as a compression spring and a torsion spring may be selected for the reset piece 5.

Figure 13:
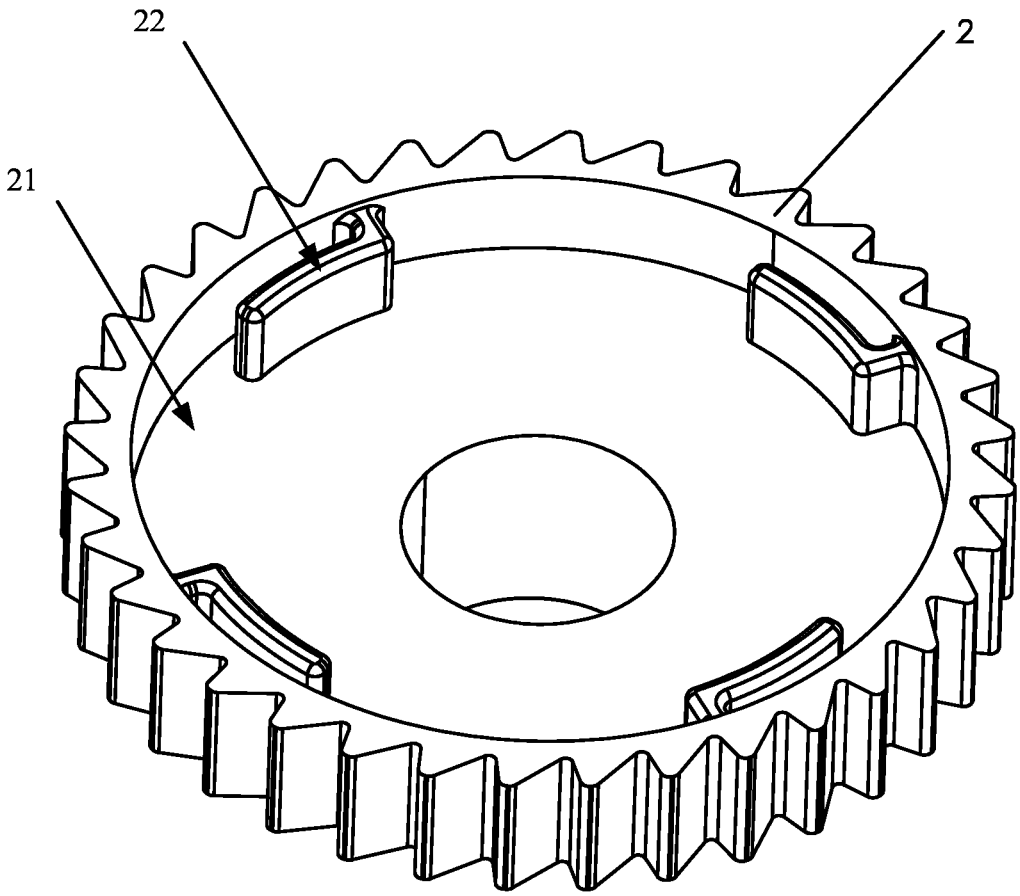
FIG. 13 is a schematic structure diagram of a ratchet wheel provided by an embodiment of the present disclosure.

FIG. 13 is a schematic structure diagram of the ratchet wheel 2 provided by the embodiment of the present disclosure. As shown in FIG. 13, in one implementation, the ratchet wheel 2 is provided with a groove 21, and a first protrusion 22 is formed at the bottom of the groove 21. Further, the coil spring is arranged in the groove 21, and a first end of the coil spring is connected with the first protrusion 22. Therefore, when the ratchet wheel 2 rotates in the first direction X, the coil spring may be twisted by the first protrusion 22. It should be noted that in the present implementation, four first protrusions 22 are provided and are distributed at intervals at the bottom of the groove 21. Through the plurality of first protrusions 22, the coil spring may be conveniently arranged, and the coil spring may be arranged on different first protrusions 22 according to required elastic force.

Figure 14:
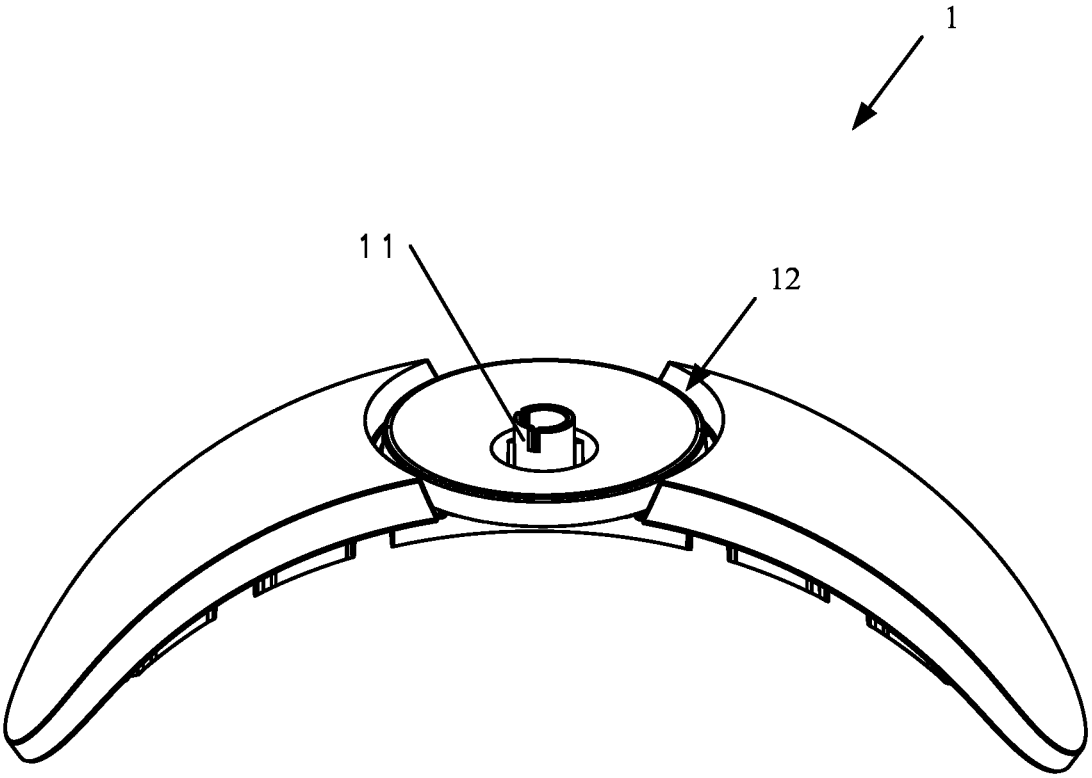
FIG. 14 is a schematic structure diagram of a fixing base provided by an embodiment of the present disclosure.
Figure 15:
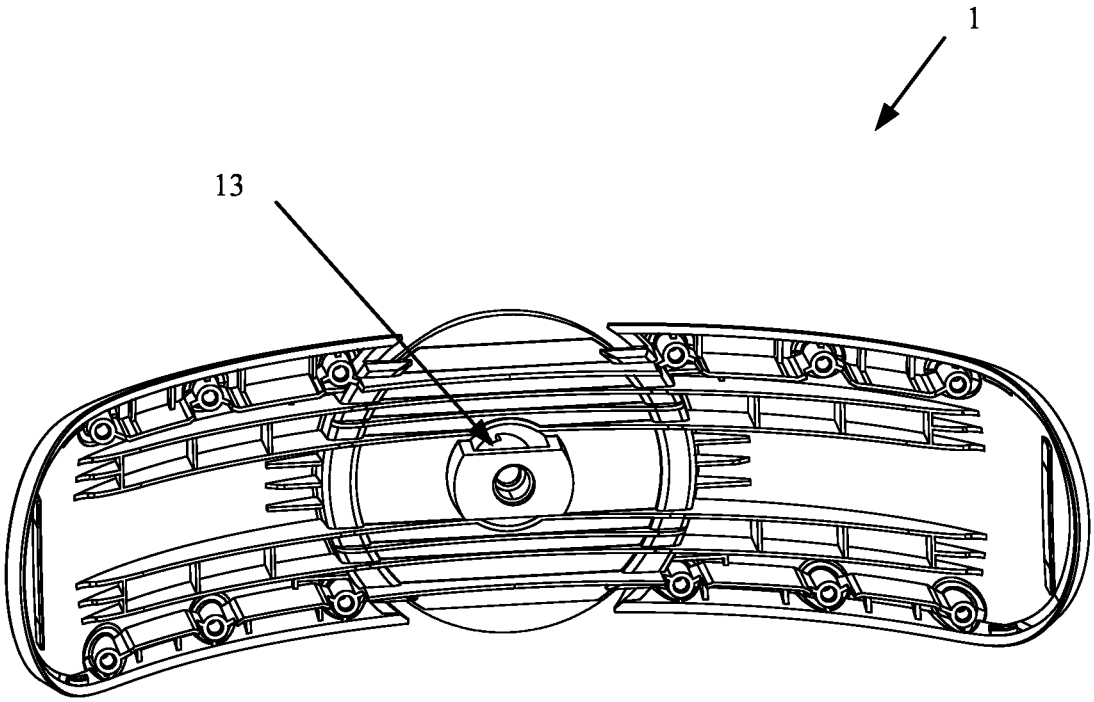
FIG. 15 is a schematic structure diagram of another view of a fixing base provided by an embodiment of the present disclosure.

FIGS. 14 and 15 are schematic diagrams of the fixing base 1 provided by the embodiments of the present disclosure. As shown in FIGS. 14 and 15, in one implementation, the fixing base 1 is provided with a second protrusion 11. Further, the ratchet wheel 2 is arranged on the second protrusion 11 in a sleeving manner. That is, the ratchet wheel 2 rotates around the second protrusion 11. Thus, the second protrusion 11 may extend into the groove 21. It should be noted that the second protrusion 11 in the present implementation is arranged to be cylindrical, and the fixing bolt 71 may pass through the second protrusion 11 and be connected with the knob 4 in a rotatable manner. Further, the second protrusion 11 is provided with two slits, so that a second end of the coil spring is wound around a part of the second protrusion 11 through the two slits.

In one implementation, the knob 4 is arranged to be circular and the edge bulges to form a sidewall. Correspondingly, an annular groove 12 matched with the sidewall of the knob 4 is formed in the fixing base 1, so that the knob 4 may be embedded in the annular groove 12. Further, the fixing base 1 is provided with a leak structure 13, so that the fixing base 1 may partially expose the transmission wheel 6 to be in driving connection with the first fixing belt B and the second fixing belt C on the basis of ensuring that the transmission wheel 6 does not fall off.

The fixing belt adjusting mechanism A provided by the embodiment of the present disclosure rotates the knob 4 in the first direction X, so that the driving member 3 may follow the rotation, the ratchet wheel 2 may be driven to rotate through the pawl 31, and then the first fixing belt B and the second fixing belt C may move synchronously away from each other through the rotation of the transmission wheel 6. Meanwhile, the reset piece 5 is elastically deformed under the rotation of the ratchet wheel 2. Further, the knob 4 is rotated in the second direction Y, so that the reset piece 5 may be restored to the original state, the ratchet wheel 2 is driven to rotate in the second direction Y, and then the first fixing belt B and the second fixing belt C may move synchronously towards each other through the rotation of the transmission wheel 6. Therefore, the user only needs to rotate the knob 4 in different directions to achieve the effect of synchronously adjusting the first fixing belt B and the second fixing belt C. That is, the user only needs to rotate the knob 4 to loosen or tighten the two fixing belts.

The wearable device provided by the embodiment of the present disclosure may achieve the effect of synchronously adjusting the first fixing belt B and the second fixing belt C through the fixing belt adjusting mechanism A described above. In one implementation, the transmission wheel 6 is arranged in a gear structure, and the first fixing belt B and the second fixing belt C are correspondingly provided with racks. The racks are meshed with the transmission wheel 6 in different directions, so that the first fixing belt B and the second fixing belt C may move synchronously towards or away from each other when the transmission wheel 6 rotates. As an optional implementation, the first fixing belt B and the second fixing belt C may be in driving connection with the transmission wheel 6 in another way (for example, chain drive).

Embodiments of the present disclosure provide a fixing belt adjusting mechanism and a wearable device. The fixing belt adjusting mechanism includes a fixing base, a ratchet wheel, a driving member, a knob, a reset piece and a transmission wheel. The ratchet wheel, the driving member and the knob are arranged on the fixing base in a rotatable manner, and the driving member may be rotated by the knob, so that a pawl drives the ratchet wheel to rotate in a first direction. Meanwhile, both ends of the reset piece are respectively connected with the fixing base and the ratchet wheel, so that the ratchet wheel may be driven to rotate and reset in a second direction. In addition, the transmission wheel coaxially and fixedly connected with the ratchet wheel may drive a first fixing belt and a second fixing belt to move towards or away from each other through rotation. Therefore, the fixing belt adjusting mechanism may achieve the effect of synchronously adjusting two fixing belts using a simple structure, which facilitates improving the user experience.

The above description is only the preferred embodiment of the present disclosure and is not intended to limit the present disclosure, and various modifications and changes may be made in the present disclosure for those skilled in the art. Any modification, equivalent replacement, or improvement made within the spirit and principle of the present disclosure should be inclusive in the protection scope of the present disclosure.

We claim:

1. A fixing belt adjusting mechanism, comprising:

a fixing base (1);

a ratchet wheel (2), arranged on the fixing base (1) in a rotatable manner;

a driving member (3), arranged with a pawl (31) matched with the ratchet wheel (2) and arranged on the fixing base (1) in a rotatable manner;

a knob (4), arranged on the fixing base (1) in a rotatable manner and configured to drive the driving member (3) to rotate, so that the pawl (31) drives the ratchet wheel (2) to rotate in a first direction (X);

a reset piece (5), wherein both ends of the reset piece (5) are respectively connected with the fixing base (1) and the ratchet wheel (2), and the reset piece (5) is configured to drive the ratchet wheel (2) to rotate and reset in a second direction (Y); and a transmission wheel (6), coaxially and fixedly connected with the ratchet wheel (2) and configured to drive a first fixing belt (B) and a second fixing belt (C) to move towards or away from each other through rotation;

wherein one end of the reset piece (5) is fixedly arranged on the fixing base (1), the other end of the reset piece (5) rotates with the ratchet wheel (2).

2. The fixing belt adjusting mechanism according to claim 1, wherein the fixing belt adjusting mechanism (A) further comprises:

a fastening component (7), wherein the fastening component (7) is arranged on the fixing base (1) and connected with the knob (4) for fastening the knob (4).

3. The fixing belt adjusting mechanism according to claim 2, wherein the fastening component (7) comprises:

a fixing bolt (71), wherein the fixing bolt (71) is fixedly arranged on the fixing base (1), a top end of the fixing bolt (71) is connected to the knob (4) in a rotatable manner, and a bottom end of the fixing bolt (71) is provided with a flange (711); and a fastening spring (72), wherein the fastening spring (72) is arranged on the fixing bolt (71) in a sleeving manner, and both ends of the fastening spring (72) respectively abut against the fixing base (1) and the flange (711).

4. The fixing belt adjusting mechanism according to claim 3, wherein the fixing bolt (71) comprises a main body part (712) and a connecting part (713) extending from the top end of the main body part (712) towards the knob (4);

the fastening spring (72) is arranged on the main body part (712) in a sleeving manner;

the flange (711) is located at the bottom end of the main body part (712); and the fixing bolt (71) is connected with the knob (4) in a rotatable manner through the connecting part (713).

5. The fixing belt adjusting mechanism according to claim 1, wherein the driving member (3) is provided with a stressed part (32); and the knob (4) is provided with a pushing part (41), and the knob (4) is configured to push the stressed part (32) to rotate in the first direction (X) through the pushing part (41).

6. The fixing belt adjusting mechanism according to claim 1, wherein the knob (4) is provided with a lifting part (42), and the knob (4) is configured to lift the pawl (31) away from the ratchet wheel (2) through the lifting part (42).

7. The fixing belt adjusting mechanism according to claim 1, wherein the reset piece (5) is a coil spring, and both ends of the coil spring are respectively connected with the fixing base (1) and the ratchet wheel (2).

8. The fixing belt adjusting mechanism according to claim 7, wherein the ratchet wheel (2) is provided with a groove (21), and a first protrusion (22) is formed at the bottom of the groove (21); and the coil spring is arranged in the groove (21), and a first end of the coil spring is connected with the first protrusion (22).

9. The fixing belt adjusting mechanism according to claim 8, wherein the fixing base (1) is provided with a second protrusion (11);

the ratchet wheel (2) is arranged on the second protrusion (11) in a sleeving manner, so that the second protrusion (11) is located in the groove (21); and a second end of the coil spring is connected with the second protrusion (11).

10. A wearable device, comprising:

the fixing belt adjusting mechanism (A) according to claim 1; and a first fixing belt (B) and a second fixing belt (C), wherein the first fixing belt (B) and the second fixing belt (C) are configured to be in driving connection with the transmission wheel (6) in opposite directions.

* * * * *